United States Patent [19]

Finch

[11] 4,274,320

[45] Jun. 23, 1981

[54] ONE KEY CHORDING SYSTEM FOR ELECTRONIC KEYBOARD INSTRUMENT

[75] Inventor: Robert A. Finch, Palos Park, Ill.

[73] Assignee: CBS Inc., New York, N.Y.

[21] Appl. No.: 47,171

[22] Filed: Jun. 8, 1979

[51] Int. Cl.[3] ..... G10H 1/00

[52] U.S. Cl. ..... 84/1.01; 84/DIG. 22; 84/DIG. 23

[58] Field of Search ..... 84/1.01, 1.03, DIG. 22, 84/DIG. 23

[56] References Cited

U.S. PATENT DOCUMENTS

| | | | |
|---|---|---|---|
| 4,054,868 | 10/1977 | Rose | 84/478 |
| 4,203,345 | 5/1980 | Collin et al. | 84/478 |

*Primary Examiner*—J. V. Truhe
*Assistant Examiner*—Forester W. Isen
*Attorney, Agent, or Firm*—Spencer E. Olson

[57] ABSTRACT

A one key chording system for an electronic organ of the type in which single contact keyswitches for D.C. keying of tone signals are employed. The keyswitches of a first group are connected to a common bus to which is also connected a mode select circuit for selectively applying thereto a D.C. potential of either positive or negative polarity. In the disclosed embodiment, when a negative potential is applied to the common bus a signal from an actuated keyswitch in said first group operates one of a plurality of chord logic circuits to produce a plurality of auxiliary keying signals which operate tone signal keyers for tone signals corresponding to a musical chord. An alpha-numeric display disposed adjacent to the keyboard indicates the name of the chord being played by the one key chording system. When the mode select circuit is operated to apply a positive potential to the common bus, the chord logic circuits are rendered inoperative and the instrument is returned to normal operation with multiple key chording.

13 Claims, 10 Drawing Figures

FROM KEYSWITCHES AND TO READOUT LOGIC
TO PEDAL
TO KEYERS
CHORD LOGIC Nº2
CHORD LOGIC Nº3
CHORD LOGIC Nº4
CHORD LOGIC Nº5
CHORD LOGIC Nº6
CHORD LOGIC Nº7
CHORD LOGIC Nº8
CHORD LOGIC Nº9
CHORD LOGIC Nº10
CHORD LOGIC Nº11
CHORD LOGIC Nº12
7th ENABLE
MINOR ENABLE
MAJOR ENABLE
CLEAR

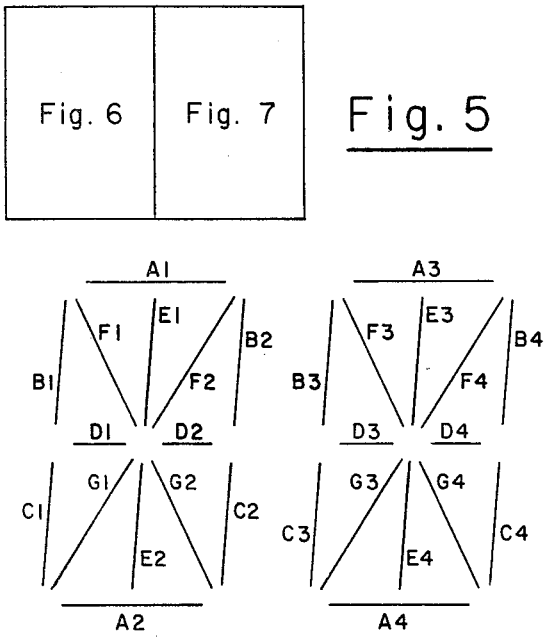
Fig. 5
Fig. 7A
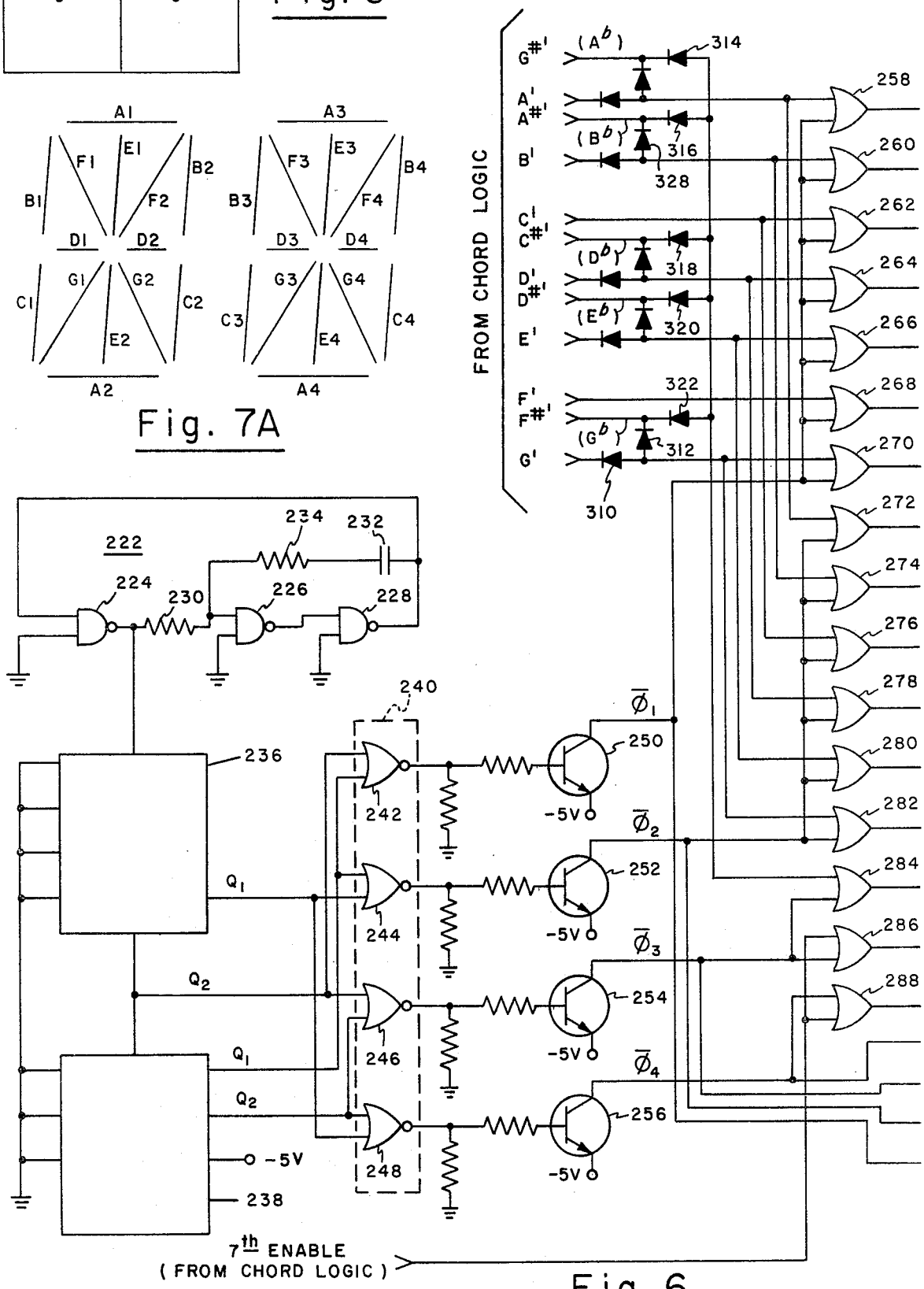
Fig. 6

ONE KEY CHORDING SYSTEM FOR ELECTRONIC KEYBOARD INSTRUMENT

BACKGROUND OF THE INVENTION

This invention relates to one key chording systems for electronic keyboard instruments in which actuation of a single key on a standard keyboard causes the sounding of a complete musical chord rather than a single note at a single pitch or multiple pitches.

Prior art systems for accomplishing one key chording on a standard keyboard have typically involved either A.C. keying of chord tone signals using multiple contacts associated with each key of the keyboard, or D.C. keying of chord tone signals. Early examples of one key chording systems employing D.C. keying are Bohm U.S. Pat. No. 3,681,508 and Southard U.S. Pat. No. 3,740,449, and more recent examples are illustrated in Robinson et al U.S. Pat. No. 3,725,560 and Schreier U.S. Pat. No. 4,000,674.

In the system disclosed by Robinson et al, the signals from the keyswitches operated by the playing keys are routed to gates and the signals from the gates are then routed through inverters to the control terminals of the keyers. In the conventional playing mode, the signal from each actuated keyswitch is routed through a gate to a single inverter and, when the organ is adjusted to play chords, the signal from each of the chord playing keys of the lower manual is routed to a group of gates with the signals from the group of gates being connected to a group of the aforementioned inverters to supply actuating signals to a plurality of the keyers, thereby making up a musical chord. The switching employed for selecting between the chord playing mode and the conventional mode is accomplished by D.C. logic and control of the keyers is also achieved by D.C. logic.

The one key chording system disclosed in U.S. Pat. No. 4,000,674 is designed for use in an electronic keyboard instrument employing single contact keyswitches for D.C. keying of tone signals. A primary keying signal from an actuated keyswitch operates one of a plurality of chord gates to produce a chord keying signal which is translated by one of a set of chord logic units into secondary keying signals. The primary and secondary keying signals operate keyers for tone signals corresponding to a musical chord. The chord gates are activated at all times and an inhibit circuit under control of a mode control circuit prevents the chord gates from responding to secondary keying signals thereby to switch the single key chording system off to return the instrument to normal operation.

Another known one key chording system is the "Magic Genie Chords" system used in the Lowrey organ and described in the Service Manual for Lowrey's Model TG-1. This system has the capability of playing forty-eight chords semi-automatically utilizing thirteen keys of the lower manual plus a foot switch on one side of the expression pedal of the organ. The twelve major chords of the musical scale can be produced by playing only one key at a time, with the name of the key depressed always corresponding to the name of the chord produced. The second lowest A key (A2) is reserved for changing any one-finger chord from a major chord to a dominant seventh chord; that is, simultaneous actuation of the C and A2 keys will produce a C dominant seventh chord, or depressing a D key and a A2 key simultaneously will produce a D dominant seventh chord, etc. Either major or dominant seventh chords may be changed to minor chords by simultaneously depressing the aforementioned foot switch on the expression pedal.

It is the primary object of the present invention to provide a one key chording system for a D.C. keyed electronic keyboard instrument which utilizes the same keyboard contacts and D.C. keyers that are employed in the normal multiple key chording operation of the instrument, which has the same chord-playing capability as the Lowrey system but whose implementation is simpler than any of the referenced prior art systems, thereby enabling provision of this feature on an electronic keyboard instrument at minimum cost.

SUMMARY OF THE INVENTION

Briefly, the one key chording system according to the invention utilizes the same keyswitches and D.C. keyers that are employed in the normal multiple key chording operation of the instrument. A first group of the keyswitches (the lower twelve keys in the case of a spinet organ) are connected to a common bus, which in turn, is connected to a mode select circuit for selectively applying a D.C. potential of either positive or negative polarity, and each of predetermined amplitude. In the disclosed embodiment, when a predetermined negative potential is applied to the common bus and one of the keyswitches in the first group is actuated, one of a plurality of chord logic circuits is operated to produce a plurality of auxiliary keying signals which operate tone signal keyers for tone signals corresponding to a musical chord. An alpha-numeric display disposed adjacent to the keyboard and controlled by signals from the chord logic circuits indicates the chord being played by the one key chording system. When the mode select circuit is operated to apply a predetermined positive potential to the common bus, the chord logic circuits are rendered inoperative and the instrument returned to normal play operation. In short, the polarity of the potential applied to the common bus for the chording keyswitches determines whether the system is in the normal play mode or the one finger chording mode, thereby precluding the possibility of both modes being activated simultaneously; that is, the system is foolproof and relatively inexpensive to implement because of the absence of need for inhibit or other logic circuitry.

BRIEF DESCRIPTION OF THE DRAWINGS

Other objects, features and advantages of the invention will become apparent, and its organization and method of operation better understood, from the following description, taken in conjunction with the accompanying drawings, wherein like reference characters refer to like elements and in which;

FIG. 5 illustrates the manner in which FIGS. 6 and 7 are assembled to make a complete circuit diagram of readout logic useful with the invention;

FIGS. 6 and 7 together constitute a schematic diagram of logic circuitry for controlling an alpha-numeric display of the name of the chord played by the system of FIG. 1;

FIG. 7A is a logic diagram of the alpha-numeric display utilized in the system of FIGS. 6 and 7;

DETAILED DESCRIPTION

Figure 1:
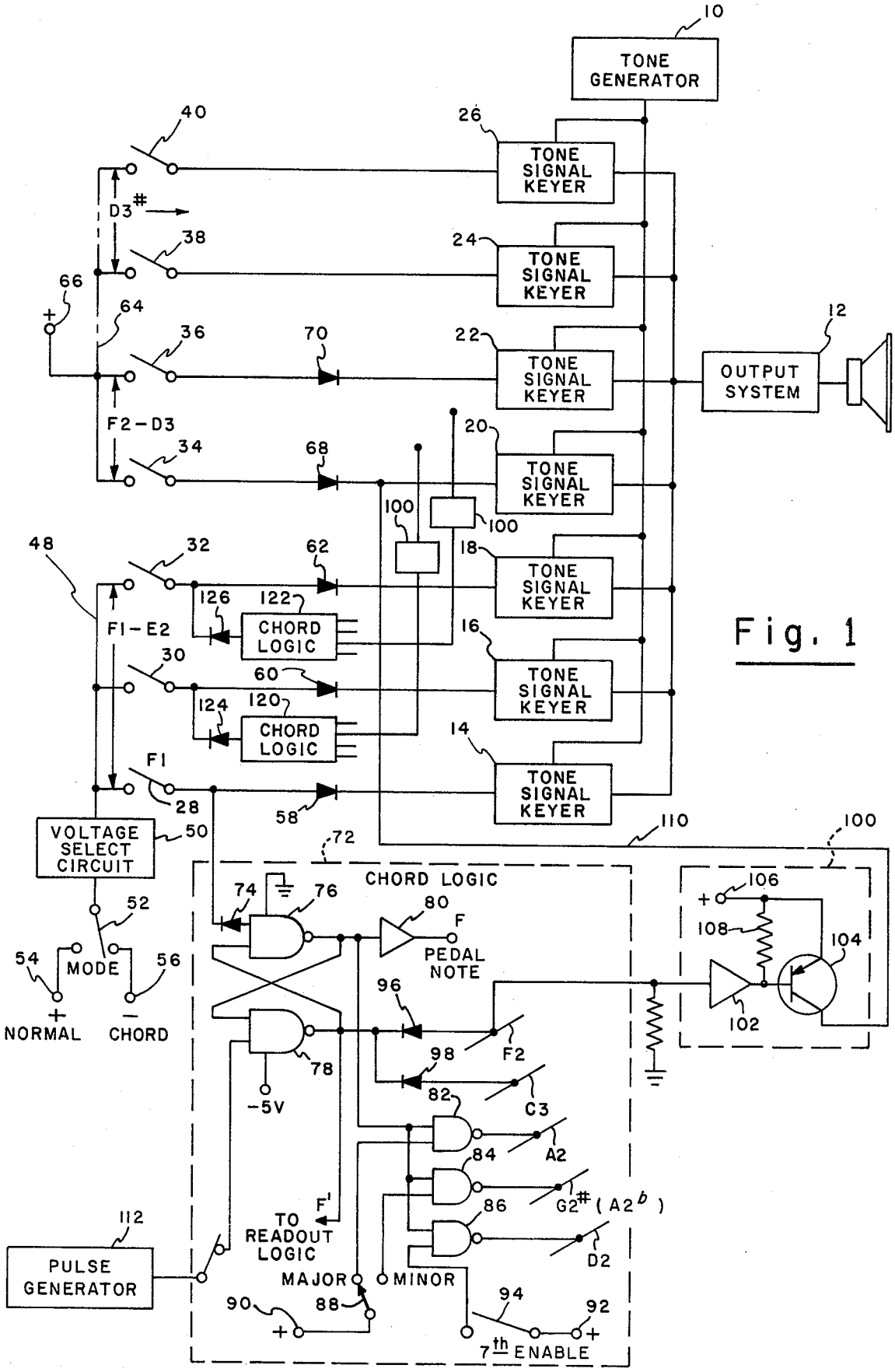
FIG. 1 is a block diagram of a one key chording system according to the present invention.
Figure 2:
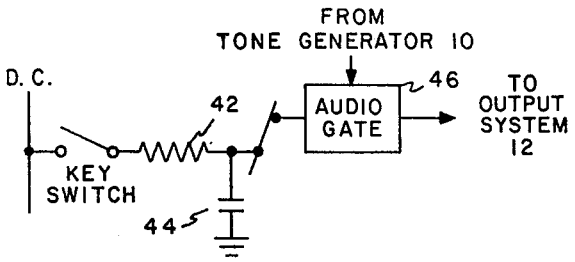
FIG. 2 is a schematic diagram of a form of tone signal keyer typically employed in the system of FIG. 1.

Referring to the drawings and particularly to FIG. 1, the present one key chording system is shown embodied in an electronic keyboard instrument which includes the following well-known elements: a tone generator 10 for generating tone signals corresponding to notes in the musical scale; an output system 12 which includes voicing and other signal modifying circuits known in the prior art for translating tone signals into audible musical tones; a set of tone signal keyers, one for each key of the keyboard instrument, seven of which are shown at 14–26, and each connected to receive one of the tone signals from tone generator 10 and being responsive to a keying signal to key the tone signal to the output system; and a keyboard having a plurality of keyswitches corresponding to the number of keys on the keyboard, seven of which are illustrated at 28–40. One contact of each of the keyswitches is connected to a source of D.C. potential and when a key switch is actuated a primary keying signal is applied on the input keying signal lead of an associated keyer. The signal keyers may be any of several forms known in the electronic organ art, with the selection dependent on the nature of the tone generator 10. Typically, the keyers may be of the form illustrated in FIG. 2 which includes an envelope circuit consisting of a resistor 42 connected to a respective keyswitch and a capacitor 44 connected to a source of reference potential, such as ground, with the envelope circuit connected to apply an envelope control signal to one or more audio gates 46 which gate a tone signal from tone generator 10 to output system 12. Alternatively, each tone signal keyer may be a keyed oscillator operative in response to a keying signal from the associated keyswitch to generate the appropriate note for delivery to the output system. The details of the tone signal keyer are unimportant to the present invention and suffice it to say that each is responsive to a keying signal on its input keying terminal to key a respective tone signal to the output system of the instrument.

One key chording control is achieved by connecting a first group of twelve keyswitches, for keys F1 through E2 in the illustrated embodiment, to a common bus 48 to which a D.C. potential is applied by a voltage select circuit 50 controlled by a mode control schematically shown as a switch 52 selectively connectable to either a source of positive potential, represented by terminal 54, or a source of negative potential, represented by terminal 56. In this embodiment the potential of the positive terminal is approximately 15 volts and terminal 56 is approximately 6 volts negative with respect to ground. When mode control 52 (which may take form of a switch on the console of the musical instrument) is set to the "normal" position and the keyswitch 28 (F1) is closed, a positive potential is conducted via a diode 58 to tone signal keyer 14 which keys the associated tone signal from tone generator 10 to the output system 12. Similarly, so long as the potential on bus 48 is positive, closure of any of the other keyswitches in the aforementioned first group of twelve (only two others of which are illustrated) will cause a keying signal to be applied to an associated keyer via associated diodes, for example, diodes 60 and 62 respectively associated with keyswitches 30 and 32.

A second group of ten keyswitches associated with keys F2 through D3, two of which are shown at 34 and 36, are connected to a second common bus 64, separate from bus 48, to which a positive D.C. potential of approximately 15 volts is applied from a source represented by terminal 66. For reasons which will presently become apparent, each of the keyswitches in this second group is connected via a respective diode 68 and 70 to a respective tone signal keyer. The balance of the keyswitches of the keyboard (i.e., those not associated with keys included in the first and second groups) are also connected to common bus 64 and each is directly connected to a respective tone signal keyer. From the description thus far it will be evident that when mode control 52 is in the "normal" play position, buses 48 and 64 are both at positive potential thereby enabling normal operation with multiple key chording.

One key chording is achieved with a set of chord logic circuits, each connected to one keyswitch of the first preselected group, one of which is shown within the dotted line enclosure 72 in FIG. 1 as connected to the keyswitch 28 associated with key F1. More particularly, keyswitch 28 is connected via a diode 74, which is poled oppositely to diode 58, to one input of a NAND gate 76 connected in a latch configuration with a second NAND gate 78. That is, the output of each of gates 76 and 78 is connected as one input to the other gate. If mode control switch 52 is switched to the "chord" mode so as to apply −5 volts to common bus 48, closure of switch 28 will not cause application of a keying signal to keyer 14 because diode 58 will be reverse biased; instead, diode 74 will conduct causing the output of NAND gate 76 to go positive, and because of the latch configuration, causing the output of gate 78 to go low. The output of gate 76 is applied to the input of a buffer amplifier 80 which produces a positive voltage at its output which operates the F pedal of the instrument to generate an F pedal note.

The output of NAND gate 76 is also applied as one input to each of three additional NAND gates 82, 84 and 86, the output of each of which will go low when the output of gate 76 is high and a positive potential is applied to its other input. A switch 88 connected to a source of positive potential, represented by terminal 90, enables selective application of the positive potential to the second input of one or the other (but not both) of gates 82 and 84; when gate 82 is selected an auxiliary keying signal is produced at its output, and when gate 84 is energized an auxiliary signal is generated at its output. The outputs of gates 82 and 84 are respectively connected to the keying terminal of the tone signal keyers associated with playing keys A2 and G2♯ (or A2♭); thus, the A2 key would play in the case of a major chord and the G2♯ (A2♭) would play in the case of the minor chord. The switch 88 shown schematically in FIG. 1, may be an external selector switch mounted on the organ console or a logic circuit operative to select between major and minor chords. Either the major or the minor chords may be changed to seventh chords by applying a positive potential to the second input of gate 86 from a source, represented by terminal 92, by closure of a switch 94. The signal at the output of gate 86 is applied to the keying input terminal of the tone signal keyer associated with key D2. The output of NAND gate 78 is fed through diodes 96 and 98 and comprise auxiliary keying signals for the keyers associated with keys F2 and C2, the other two constant notes in the F chord.

Each key of the keyboard system that is to be played under control of the one key chording system (and this will include keys in the aforementioned second group and some of the keys in the first group) is provided with a buffer circuit 100 for coupling the auxiliary keying signal from the chord logic to the keyer. Each such circuit, only one of which is shown connecting diode 96 to the keying terminal of tone signal keyer 20 associated with key F2, includes a buffer amplifier 102 the output terminal of which is connected to the base electrode of a transistor 104, the emitter electrode of which is connected to a source of positive potential, represented by terminal 106, and through resistor 108 to the base. The signal produced at the collector of transistor 104 is coupled by conductor 110 to the keying terminal of tone signal keyer 20. It will be understood that each of the other outputs of the illustrated chord logic system is also connected via a like buffer circuit to the keying terminal of the appropriate keyer. Thus, when keyswitch F1 is depressed and the major chord is selected, the described logic circuit causes keys F2, C2 and A2, as well as the F pedal note, to play; if switch 94 is simultaneously closed, key D2 additionally will play. If the minor chord is selected, the described logic circuit will cause the F pedal note, and keys F2, C2 and G2# (A2♭) to play.

To ensure that the chord logic is disabled when the played key (in this case F1) is released, a train of pulses from a pulse generator 112, having a pulse repetition frequency typically of about 100 Hz, is applied to the second input of NAND gate 78, thus to apply a clearing pulse to the latch every ten milliseconds. As long as key F1 is held the output of gate 76 will be positive and the output of gate 78 will remain essentially negative, except for going positive for the brief periods of the clearing pulses, but these pulses, being much shorter than the usual keying envelope of the tone signal keyers, will not be heard in the output system. When the played key is released, the next following pulse from pulse generator 112 resets the latch to the "off" condition, in which auxiliary keying signals are no longer generated, causing cessation of play of the notes comprising the chord.

As has been noted earlier, each of the keys in the first preselected group has a chord logic circuit of the described configuration (two additional ones of which are illustrated in block diagram form at 120 and 122) connected to a respective keyswitch via a diode which is poled oppositely to the diode which transmits the primary keying signal. The diodes for chord logic circuits 120 and 122 are shown at 124 and 126, respectively. It will be understood that the auxiliary keying signals produced by each of the other eleven chord logic circuits are coupled to the appropriate keyers to sound the notes of the associated chords.

Summarizing, the present one key chording system requires a chord logic circuit for each keyswitch in the first preselected group which, in the case of a spinet organ, are the keyswitches associated with the first twelve notes, namely, F1 through E2. In a console organ, logic circuits would be connected to each of keys six through seventeen (corresponding to keys F1 through E2); thus, the described chord logic and other hardware can be the same for both console and spinet organs. A buffer circuit 100 is required for each key that is played from the twelve chord logic circuits and, of course, a tone signal keyer is required for each key of the keyboard instrument. Only one pulse generator 112 is required to reset the latches of all of the chord logic circuits.

It will be evident from the foregoing description that the polarity of the bus which is common to keyswitches having chord logic circuits associated therewith controls the entire one key chording system; when the bus potential is negative the chord logic circuits are enabled and normal keying is disabled, and when the bus polarity is positive the chord logic circuits are automatically removed and the keyboard system operates normally. No additional logic or inhibit circuitry is required to say that the system is in one mode or the other, and there is no possibility of the system being in both modes at the same time.

Figure 3:
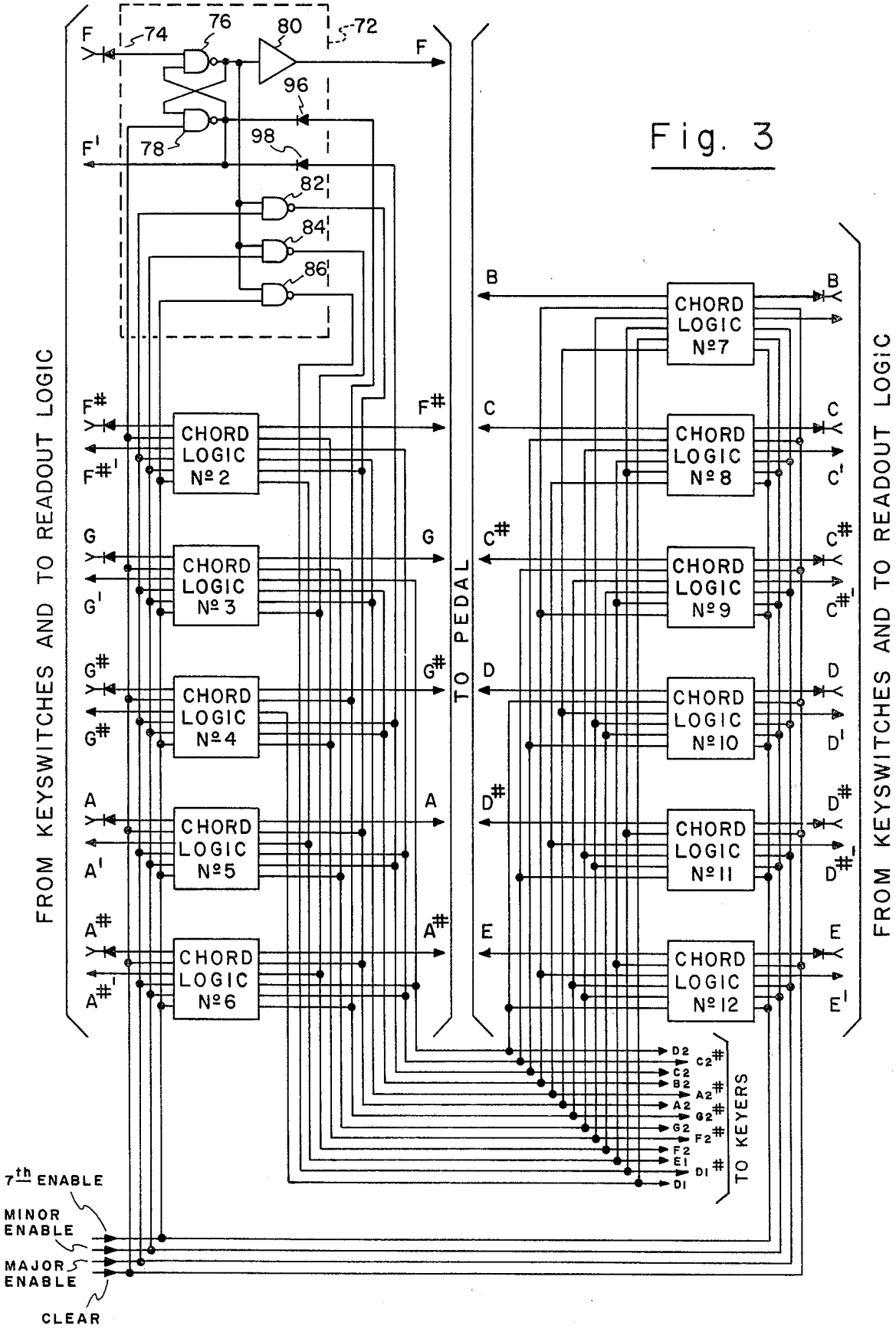
FIG. 3 is a schematic diagram, partly in block diagram form, of the system of chord logic circuits employed in the system of FIG. 1.

FIG. 3 illustrates schematically the interconnection of the twelve chord logic circuits respectively associated with keyswitches F1 through E2. The internal connections of the chord logic circuit 72 connected to the F1 keyswitch are again illustrated in the upper left-hand corner of the figure; the other eleven chord logic circuits have the same internal connections. It is to be understood that the input and output connections to the block representing chord logic circuits #2 through #12 are in the same relative positions as the input and output connections shown in the schematic illustration of logic circuit 72. Chord logic circuits #2 through #12 are respectively connected via a diode to the keyswitches associated with playing keys F#, G, G#, A, A#, B, C, C#, D, D# and E, and respectively produce a signal for producing a correspondingly named pedal note. It will be noted that a "CLEAR" pulse (from pulse generator 112 in FIG. 1) is applied as one input to the NAND gate corresponding to gate 78 in all of the logic circuits, and that control lines are connected to the second input of the NAND gates in each of the chord logic circuits corresponding to gates 82 84 and 86 for applying "7th ENABLE", "MINOR ENABLE" and "MAJOR ENABLE" control signals, respectively. The five output lines from each of the chord logic circuits (in addition to the pedal note output) are connected to a selected five of twelve output lines connected through respective buffers (not shown in FIG. 3) to the tone signal keyers associated with playing keys D1 through D2. The described and illustrated interconnections ensure that the name of the chord produced corresponds to the name of the key depressed.

It will be recalled from the description of chord logic circuit 72 that when the associated keyswitch is depressed the latch configuration causes the output of NAND gate 78 to go low. These signals, from the output of gate 78 in each of the twelve chord logic circuits, are applied to logic (to be described) for controlling an alpha-numeric display which indicates the chord being played. The signals from the chord logic circuits to be applied to the readout logic are distinguished from the actuating signal from an associated keyswitch by the prime notation on the readout logic signals. For example, in the case of chord logic circuit 72, the incoming signal from the keyswitch is designated F, whereas the signal applied to the readout logic is designated F'.

Figure 4:
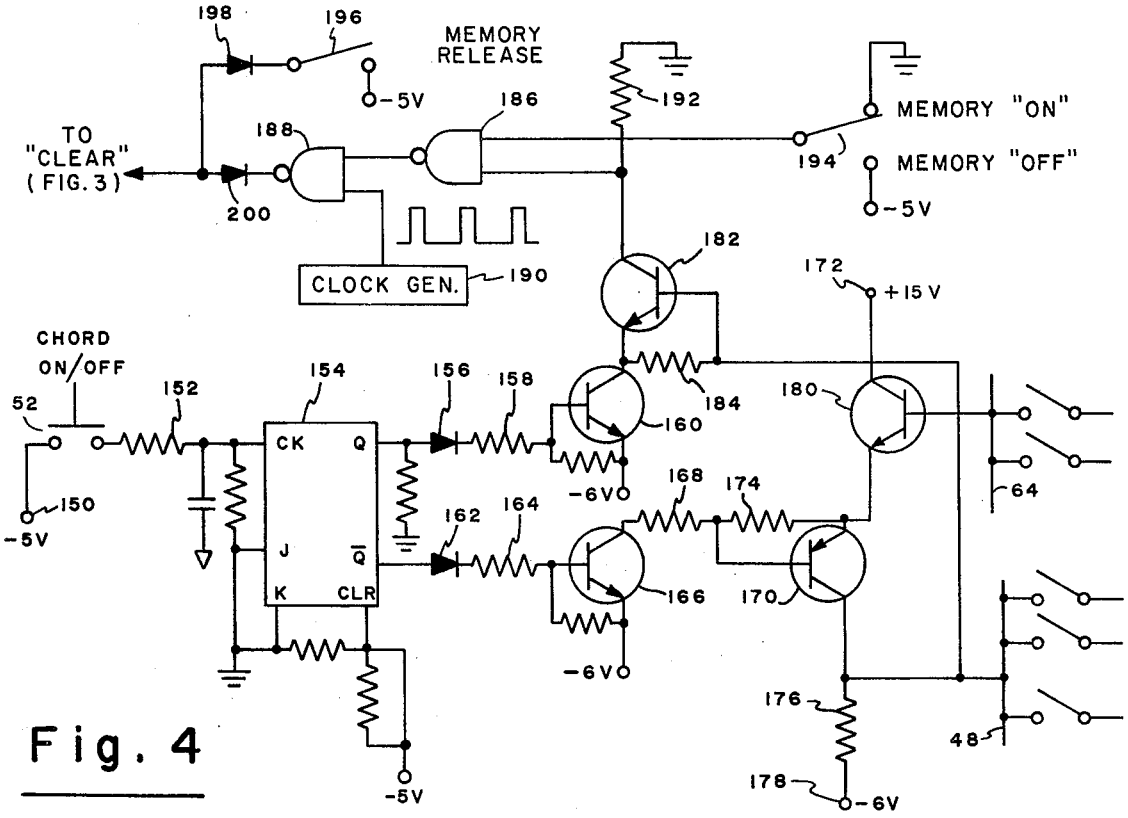
FIG. 4 is a schematic diagram of a mode select control useful in the system of FIG. 1.

FIG. 4 is a schematic diagram of a suitable mode control and voltage select system for switching the polarity and potential of the D.C. voltage applied to the bus that is common to the aforementioned first group of keyswitches. The system is controlled by a "chord on/-off" switch 52, the stationary contacts of which are respectively connected to a voltage source represented by terminal 150 having a potential of −5 volts, and via resistor 152 to the clock input of a "JK"-type flip-flop circuit 154. The Q output of the flip-flop is applied via a diode 56 and a resistor 158 to the base electrode of a transistor 160, and the $\overline{Q}$ output is connected by a diode 162 and a resistor 164 to the base electrode of a transistor 166. The emitter of each of transistors 160 and 166 is connected to a −6 volt source, and also through a resistor to the base electrode. The collector of transistor 166 is connected via resistor 168 to the base electrode of a transistor 170, the emitter electrode of which is connected to the emitter electrode of a transistor 180, and via a resistor 174 to the base electrode. The collector of transistor 170 is connected via a resistor 176 to a −6 volt source, represented by terminal 178, and also to keyswitch common bus 48. The base of transistor 180 is connected to the normal keyswitch common 64 for keys 13 through 44 (assuming a spinet organ), and its collector is connected to a +15 volts source, represented by terminal 172. The keyswitch common bus 48 is connected to the base electrode of a transistor 182 and through resistor 184 to the emitter of transistor 182, which is connected to the collector electrode of transistor 160. The collector of transmitter 182 is connected to one input of a NAND gate 186. The collector of transmitter 182 will be at ground or zero potential when no keyswitches in the chord select area of the keyboard are held. When a switch is depressed the collector of transistor 182 will go low and apply a potential of approximately −5 volts at the said one input of NAND gate 186. The other terminal of NAND gate 186 is connected to a switch 194 which controls whether the chord "memory" is "off" or "on".

When switch 194 is in the memory "off" mode, the other terminal of gate 186 is connected to a source of −5 volts. Any negative input at either of the input terminals will cause the output of NAND gate 186 to be positive or high, which, in this case, is ground potential. The output of gate 186 is applied to one input of a second NAND gate 188, and a clock generator 190 applies a train of narrow pulses to the other input terminal of gate 188; the duty cycle of these pulses is very short, in the order of approximately two percent or less. The frequency is not critical, but in the described embodiment it is a few hundred cycles per second. If both input terminals of NAND gate 188 are positive (that is, a positive potential applied from the output terminal of NAND gate 186 and positive pulses from the clock generator 190), a train of negative pulses appear at the output of gate 188 and are applied to the "CLEAR" line of the chord latches (FIG. 3). Whenever a negative pulse occurs, any information that has been held in chord logic latches is cleared. In the "memory off" condition, the output of NAND gate 186 will always be positive, because any negative input will cause the output to be positive; therefore, clock pulses will always be applied to the "CLEAR" line so that whenever a key is released that information is immediately lost.

If, now, switch 194 is switched to the "memory on" position, a "positive" potential is applied to the first input terminal of NAND gate 186, and whenever a key is depressed the collector of transistor 182 again will provide a negative input to the other input terminal of gate 186; therefore, the output of NAND gate 186 will be positive only while the key is held, with the consequence that negative pulses will appear at the output of NAND gate 188 only during the time the key is depressed. Therefore, when the key is released no further "CLEAR" pulses will be applied to the latches and the last to be latched latch will remain latched until another key is depressed. Thus, gates 186 and 188, clock generator 190, and the associated circuitry provide a memory function which remembers the chord that was played and holds that chord until another is played, or until a release is actuated. The depression of a "memory release" switch 196 connected between the output of gate 188 and a −5 volts source provides a steady state "clear" which will unlatch all the latches (FIG. 3). A pair of diodes 198, 200 provide wired NORing of the inputs to the clear lines from NAND gate 188 or memory release switch 196.

As will be seen, when flip-flop circuit 154 is "off" or in its first stable state the same positive potential that is normally applied to the rest of the keys is applied to bus 48 that is common to the first twelve keyswitches. Thus, in this mode the first twelve keyswitches activate their associated keyers in the normal way. When the switch 52 is momentarily closed to set flip-flop 154 into its second stable state, or "chord" mode, the combined action of flip-flop 154 and the logic provided by the described connections of transistors 160, 166, 170, 180 and 182, the keyswitch common for the first twelve keyswitches is disconnected from the normal positive D.C. potential and is connected to the −6 volt potential at terminal 178. More particularly, when the system is in the "normal" mode, flip-flop 154 is latched in the condition where Q is low; in this case, the Q potential is −5 volts by reason of operation of the flip-flop and the logic at −5 volts (nominally) so as to be compatible with the TTL logic employed in the chord logic circuits. A negative voltage at Q cuts off transistor 160, which opens the connection to transistor 182 and allows transistor 182, and keyswitch common 48 which is tied to the base electrode of transistor 182, to float at some positive voltage. At the same time, the Q output of flip-flop 154 is opposite from the Q output, in this case at zero potential, and when applied to the base of transistor 166 causes it to saturate which, in turn, causes PNP transistor 170 to saturate. This saturation of transistor 170 causes its collector to be pulled up to the positive potential of its emitter. The base of transistor 180 is connected to the normal keyswitch common 64 and the emitter is connected to the bus 48 common to the first group of twelve keyswitches. Thus, the action of transistors 170 and 180 and their associated circuitry applies to bus 48 a potential equal to +15 volts minus the voltage drops across the emitter-base junctions of the two transistors.

When switch 52 is depressed to select the "chord" mode, a −5 volt signal applied to the clock terminal of flip-flop 154 causes the flip-flop to latch in the opposite condition at which the Q output is high (0 volts in this embodiment) and $\overline{Q}$ is low. The high output at Q applied to the base of transistor 160 causes it to saturate thereby pulling the potential of its collector down to the −6 volts at its emitter; the collector of transistor 160 being connected through resistor 184 and the emitter-base junction of transistor 182 to the common bus 48, a potential of approximately −5 volts is applied to the bus. At the same time, the $\overline{Q}$ output of flip-flop 154 goes low, cutting off transistor 166 which, in turn, cuts off transistor 170 and disconnects the bus 48 from the positive potential at the base of transistor 180. Each time a keyswitch in the first group of keys is depressed, the forward current flow in the emitter/base junction of transistor 182 causes it to saturate, thus causing a "CLEAR" enable signal to occur in response to a "key-down" condition, as previously described. When the chord switch 52 is again depressed, the flip-flop 154 again latches in its "normal" state and the logic again causes a positive potential to be applied to keyswitch common 48 as well as to bus 64.

Figure 7B:
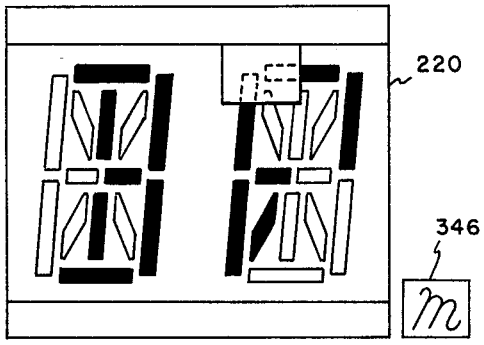
FIG. 7B is an enlarged plan view of the alpha-numeric display illustrating the indication of a B♭ seventh chord.

An important feature of the present invention is that the name of the chord being played by the one key chording system may be continuously visually displayed by an alpha-numeric display device supported on the organ console in a position to be conveniently visible to the organist. The display device preferably is a two-element light-emitting diode (L.E.D.), each element of which has fourteen segments which when selectively energized are capable of depicting a large number of letters. This form of display device, shown four times actual size in FIG. 7B, is commercially available from Litronix Corporation, their part No. DL2614. Each of the segments is a separate light-emitting diode having an anode and a cathode, and being a current-operated device, a segment is illuminated by applying a source of positive current to the anode and connecting the cathode to ground potential.

Figure 7:
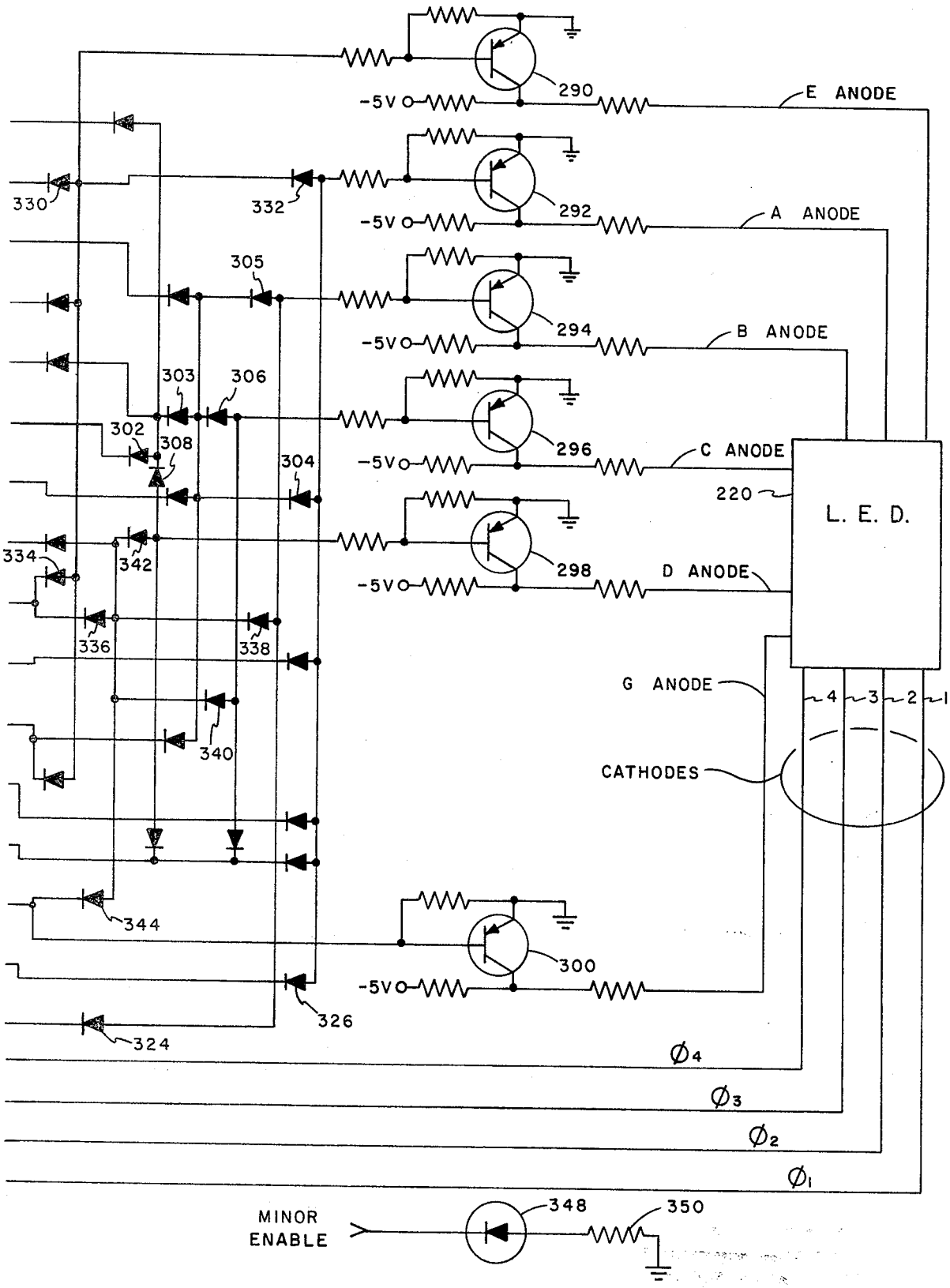

In order to cause the name of the played chord to be displayed in response to signals from the chord logic system of FIG. 3, the readout logic system illustrated in FIGS. 6 and 7 is multiplexed so as to connect to ground, on a time division basis, preselected groups of cathodes of the twenty-eight light-emitting diodes constituting the two-element display. The display period is divided into four time segments, with one group of cathodes being grounded for one-fourth of the display period, a second group of cathodes being grounded for the next one-quarter of the display period, etc. The significance of this multiplexing will be evident from the logic diagram of the L.E.D. display 220 shown in FIG. 7A in which each of the segments of each of the two elements of the display is identified by the combination of a letter and a numeral. For example, the top horizontal segment of the left-hand element is labelled A1, the lower horizontal segment of that element is labelled A2, the top horizontal segment of the right-hand element is labelled A3 and the lower horizontal segment of the right-hand element is labelled A4. The letter portion in each case designates the anode of that particular segment and the numeral identifies the cathode; for displaying the names of all possible chords seven separate groups of anodes are required, these being labelled A, B, C, D, E, F, G, together with four groups of cathodes, labelled 1, 2, 3 and 4, which are successively grounded on a time division multiplexed basis. In the logic diagram of FIG. 7A, all segments having an "A" in its label effectively have a common anode, all segments having "B" in its label have another common anode, etc. Similarly, all segments having a like numeral as part of its designation have cathodes in common; that is, all of the "1"s are a common cathode, as are all of the "2"s, "3"s. etc. To simplify the logic circuitry necessary to correctly energize selected segments, the anodes A. B, C and D are judiciously assigned to respective time slots; the significance of this will become evident from the following description of the readout logic system.

Time-division multiplexing of the cathodes of L.E.D. 220 (designated 1, 2, 3 and 4) is achieved by dividing the output of an oscillator 222 consisting of a chain of three NAND gates 224, 226 and 228, one input terminal of each of which is connected to ground and the output terminal of each connected to the other input terminal of one of the others. More particularly, the output of gate 224 is connected through a resistor 230 to the second input of gate 226, the output of gate 226 is connected to the second input of gate 228, and the output of gate 228 is connected to the second input of gate 224, and also via a capacitor 232 and a resistor 234 to the second input of gate 226. The described circuit is a simple, conventional oscillator that delivers essentially a square wave signal, the parameters being selected to generate a frequency of approximately 1 KHz. The frequency is not critical, the only requirement being that it be sufficiently high as to prevent flicker of the display. The signal from the output terminal of gate 224 is applied to an integrated circuit containing two flip-flops 236 and 238; flip-flop 236 divides the input signal by two to give two output signals $Q_1$ and $Q_2$, and the $Q_2$ signal is applied to flip-flop division 238 for further division by two to deliver two additional square wave signals, also labelled $Q_1$ and $Q_2$. These four output signals are decoded in a quad-NOR gate 240, which may take the form of a single integrated circuit containing four separate NOR gates 242, 244, 246 and 248. The $Q_1$ output from flip-flop 236 is applied to one input of each of NOR gates 244 and 248, the $Q_2$ output from flip-flop 236 is applied to one input of each of NOR gates 240 and 246, the $Q_1$ output from flip-flop 238 is applied to the second input terminal of each of gates 242 and 244, and the $Q_2$ output from flip-flop 238 is applied to the second input terminal of each of gates 246 and 248. The result of the combined action of the flip-flops and the NOR gates is that the output terminals of each of the NOR gates is positive for one-fourth of the time and the sequence is continuously cycled. The signals appearing at the output terminals of NOR gates 242, 244, 247 and 248 are applied through suitable resistive coupling networks to the base electrode of a respective transistor 250, 252, 254 and 256, the emitter of each of which is connected to a $-5$ volt source, so as to cause an inverted input signal to appear at the collector electrode of each of the transistors. The output signals from the four transistors, labelled $\phi_1$, $\phi_2$, $\phi_3$ and $\phi_4$, respectively, are directly applied to those cathodes of L.E.D. 220 grouped according to the numbers 1, 2, 3 and 4, respectively. In the case of the Litronix display device, the signals designated $\phi_1$, $\phi_2$, $\phi_3$ and $\phi_4$ are applied to pins 15, 10, 8 and 5, respectively. It can now be seen that each set of cathodes will be effectively grounded for a different one-fourth of the time on a cyclical basis, and not grounded for the remaining three-fourths of the time.

The $\phi_1$ output signal from transistor 250 is also applied as one input to each of seven OR gates 258–270, the $\phi_2$ signal is applied as one input to each of six additional OR gates 272–282, the $\phi_3$ signal is applied as one input to each of two additional OR gates 284 and 286, and the $\phi_4$ signal is applied as one input to one OR gate 288. Essential to the proper operation of the remaining portion of the logic is that each of the OR gates requires that both inputs be low in order to provide a low at the output terminal. For reasons that will be explained later, a first diode logic matrix is interposed between the chord logic (FIG. 3) and the OR gates and a second diode logic matrix follows the OR gates. Considering, by way of example, the input labelled F' from the chord logic, this input is low when the F key is depressed, thus making one input to OR gate 268 low, and the other input to this OR gate will also be low during that period of time when the $\phi_1$ signal from the transistor 250 is low. Therefore, only during the time that the $\phi_1$ signal is low, defining the first of the four time slots, will there be an output at the output terminal of gate 268. The output of OR gate 268, which is low only during the first time slot, is coupled by selected diodes in the second diode matrix and activates selected ones of six PNP transistors 290, 292, 294, 296, 298 and 300, the collector of each of which is connected through a resistor to a −5 volt source and the emitter of each of which is connected to ground. The collector of transistor 290 is connected to the common E anodes of L.E.D. 220, and the collectors of transistors 292, 294, 296, 298 and 300 are respectively connected to the A, B, C, D and G anodes of the L.E.D. When a minus current is applied to the base electrode of a transistor, a positive current is supplied to the respective anodes of those segments of the display device; in the case of the F, positive current is supplied to only those segments in the left-hand element of the display that are required to display an F, namely, A1, B1, C1 and D1. Thus, it happens that the cathodes of all of these segments are grounded during the first time slot; in other words, the segments making up an F are all energized at the same time, and for only one-fourth of the time. However, the repetition rate of oscillator 222 is sufficiently high that the eye does not see any flicker. Recalling that the output of OR gate 268 is low when the F key is depressed, and tracing the signal through the second diode matrix, it is seen that transistor 292 (for the A anode) is enabled via diodes 302, 303 and 304; transistor 294 (for the B anode) is enabled via diodes 302, 303 and 305; transistor 296 (for the C anode) is enabled via diodes 302, 303 and 306; and, transistor 298 (for the D anode) is enabled via diodes 302 and 308. Thus, for the letter F to be displayed it is necessary to simultaneously turn on the A, B, C and D anodes, and at the same time enable the cathodes designated "1".

Before considering a more complex example in which selected segments of both elements of the display are energized, it should be pointed out that only flats are displayed; that is, no sharps (♯) are displayed. The flat symbol is displayed in the right-hand element by illumination of segments B3, C3, G3 and D3, the cathodes of all of which are grounded when the $\phi_3$ signal is low, or during the third time slot. Thus, as shown in parenthesis on the first diode logic matrix, G♯ is displayed as A♭, A♯ is displayed as B♭. C♯ is displayed as D♭, D♯ is displayed as E♭ and F♯ is displayed as G♭. This fact is reflected in the arrangement of the first diode matrix to take into account that two possibilities exist for indicating a given note. For example, the note G could be a G or a G♭. Thus, the "low" signal produced when the G key is depressed is applied through a diode 310 to one input terminal of OR gate 270, and F♯, which is also G♭, instead of being applied to a separate OR gate is applied to the same input of OR gate 270 via diode 311. Similarly, B and B♭ are both applied to a common OR gate 260; D and D♯ are applied as one input to a common OR gate 264; and E and E♭ are applied to one input of a common OR gate 266. Further, to minimize the number of OR gates required, and the number of diodes in the second diode logic matrix, all of the lines on which a flat is shown are connected via respective diodes 314, 316, 318, 320 and 322 to one input of a single OR gate 284. A further saving of components is achieved by pregrouping certain groups of segments that are common to a number of characters. For example, examination of the left-hand element of FIG. 7A will reveal that segments B1 and C1 are used as a pair for each of the letters A, C, E, F and G; since any time these segments are used they are used together, they are pre-combined in the logic thereby to reduce the number of diodes required in the second diode matrix.

A seventh is displayed on the right-hand element of the display by energizing segments A3 and B4, and to improve the proportions of the numeral 7 (and also to improve the appearance of the display of the flat symbol) the upper left-hand corner of the element is masked so as to conceal the upper end of segment B3 and approximately the left half of segment A3. Both of these segments are fully illuminated but the mask prevents these portions from being seen. Turning now to that portion of the readout logic system that enables segments A3 and B4, when switch 94 (FIG. 1) is operated, a negative potential of approximately −5 volts is applied to one input terminal of each of OR gates 286 and 288, and it is seen that the $\phi_3$ signal from transistor 254 is applied as the second input to OR gate 286 and that the $\phi_4$ signal transistor 256 is applied as the second input to OR gate 288. A low at the output of OR gate 286 is coupled via a diode 326 to the base electrode of 292, thereby to enable the A anode, and a low at the output terminal of OR gate 288 is coupled via diode 324 to the base of transistor 294 to enable the B anode. Thus, the A3 segment is illuminated during the third time slot and the segment B4 is illuminated during the fourth time slot.

The operation of the readout logic will be more fully understood from a description of its operation to display the B♭ seventh chord. The B is displayed in the left-hand element of display device 220 by illumination of segments A1, B2, C2, E1, D2 and E2; the flat symbol is displayed in the right-hand element by illumination of segments B3, C3, D3 and G3, and as has just been described, the 7 (for 7th) is displayed in the right-hand element by illumination of segments A3 and B4. A low at the A♯ input (from the chord logic of FIG. 3), which is the same as B♭, is applied via a diode 328 as one input to each of OR gates 260 and 274, and also via diode 316 to one input of OR gate 284. The resulting low at the output of gate 260 during the low portion of the $\phi_1$ signal applied to the other input is applied via a diode 330 to the base of transistor 290 to enable the E anode, and additionally through diode 332 to the base of transistor 292 to enable the A anode. Since the output of OR gate 260 is low only when the $\phi_1$ signal is simultaneously present, the E and A anodes are enabled when the $\phi_1$ signal applied to the associated "1" cathodes is low, thus illuminating the A1 and E1 segments. When the output of OR gate 274 is low (i.e., during simultaneous application of a low from the chord logic and a low in $\phi_2$ signal), the signal is coupled via a diode 334 to transistor 290 to enable the E anode; through diodes 334 and 332 to the base of transistor 292 to enable the A anodes; through diodes 336 and 338 to the base of transistor 294 to enable the B anodes; through diode 336 and a diode 340 to the base of transistor 296 to enable the C anode; and, through diode 336 and a diode 342 to the base of transistor 298 to enable the D anodes. Thus, each of the E, A, B, C, and D anodes are supplied with a positive current during the periods that the signal applied to the "2" cathodes is low. Consequently, the A1, E1, A2, D2, E2, C2 and B2 segments of the left-hand element are illuminated to display the "B", depicted in FIG. 7B.

Display of the flat symbol, in the right-hand element, is achieved by coupling the low at the A# input through diode 316 to one input of OR gate 284 which, when the $\phi_3$ signal from transistor 254 is also low, produces a low at the output of gate 284. This signal is directly applied to the base electrode of transistor 300 to enable the G anodes; through diodes 344 and 340 to the base of transistor 296 to enable the C anodes; through diodes 344 and 338 to the base of transistor 294 to enable the B anodes; and through diodes 344 and 342 to the base of transistor 298 to enable the B anodes. Since these four anodes are enabled only when the $\phi_3$ signal applied to the "3" cathodes is low, segments B3, C3, D3 and G3 are illuminated to display the flat symbol, shown in FIG. 7B.

Finally, the "7" in the right-hand element is displayed by applying a negative potential (in response to actuation of the 7th enable switch) to one input of each of OR gates 286 and 288, and applying to the other input the $\phi_3$ and $\phi_4$ signals, respectively. The resulting low at the output of OR gate 286 is applied via diode 326 to transistor 292 to enable the A anode, and the low at the output of OR gate 288 is coupled via diode 324 to transistor 294, which enables the B anode. Thus, segments A3 and B4 are illuminated.

The playing of a minor chord is indicated by a separate display 364 positioned adjacent display 220 (FIG. 7B) consisting of a photographic negative having a lower case "m" thereon behind which is mounted a small light-emitting diode positioned to shine through the negative. As shown at the bottom of FIG. 7, when the minor is enabled (see FIG. 1) a negative potential is applied to the cathode of the light-emitting diode 348, the anode of which is connected to ground through a resistor 350, thereby illuminating the L.E.D.

It will be evident from the foregoing description that any letter that can be represented by the fourteen segments of one of the elements of the display can be displayed provided the proper anodes are fed positive current and the proper cathodes are grounded during the four time slots of the clock to illuminate the proper segments. All of the segments that are required to be illuminated to display all of the chords playable by the disclosed system are determined by the described diode logic. The anodes are enabled through the OR gates via a PNP transistor, one of each of the anode segments. A first group of seven OR gates is enabled during the first time slot, a second group of six OR gates is enabled during the second time slot, a third group of two OR gates is enabled during the third time slot, and a single OR gate, namely, gate 288, is enabled during the fourth time slot. The grounding of appropriate cathodes at the same time cooperating anodes are enabled determine which segments are illuminated and at what times.

Figure 8:
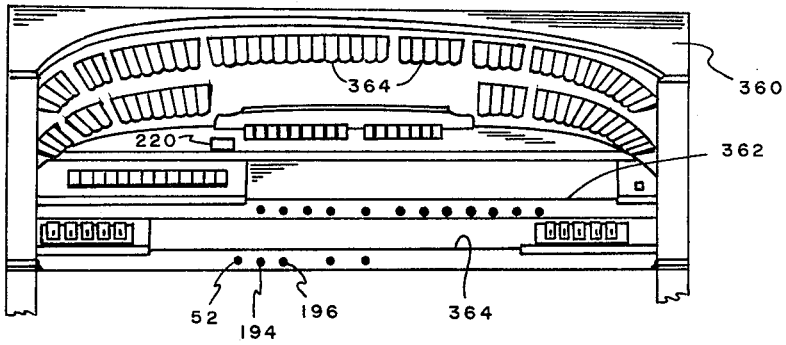
FIG. 8 is a fragmentary view of an electronic organ embodying the chord control system of the invention.

FIG. 8, which is a fragmentary front elevation view of the keyboards and control panel of an electronic organ, illustrates how the present one key chording system is embodied in the organ. The organ includes a case 360 having an upper manual keyboard 362, a lower manual keyboard 364, a multiplicity of stop tablets 364, and other control elements typically found on an electronic organ. The control switch 52 (FIG. 1) for selecting the "chord" mode when desired, preferably takes the form of a piston 52 located immediately below the lower keyboard 364. The "MEMORY ON/OFF" switch described in connection with FIG. 4 preferably takes the form of a second piston 194 disposed adjacent piston 52, and the "MEMORY RELEASE" switch is actuated by a third piston 196. Selection of the desired accompaniment chords is effected by despression of suitable keys of the lower end of the lower keyboard 364 in conjunction with suitable setting of the control switch 52. The name of the chord being played by the one key chording system is visually displayed by display device 220, which is mounted in a slightly inclined position and slightly to the left of center of the control panel, so as to be conveniently visible to the organist.

Although the readout and display logic has been described in conjunction with the chord logic system shown in FIGS. 1 and 3, it will now be clear to ones skilled in the art that the logic system is capable of visually displaying the name of the chord being played by other one key chording systems now known or as may be designed in the future. All that would be required is to derive signals from the alternative chord system functionally corresponding to the twelve signals applied to the first diode logic matrix. It will be understood, also, that the readout logic may differ in specific detail from that shown and described without departing from the spirit of the invention.

I claim:

1. In an electronic keyboard instrument which includes:

a tone signal generating system for generating tone signals corresponding to notes in the musical scale;

an output system for translating tone signals into audible musical tones;

a set of tone signal keyers, each receiving one of said tone signals and being responsive to a keying signal on a keying terminal to key said tone signal to said output system; and a keyboard having a plurality of single pole, single throw keyswitches, each identified in standard musical terms with a particular note of the musical scale;

a one key chording system comprising:

means connecting a preselected first group of said keyswitches to a first common bus;

means connecting each keyswitch of said first group to the keying terminal of a respective tone signal keyer and normally operative in response to a predetermined D.C. potential of one polarity on said first common bus and actuation of a keyswitch to supply a primary keying signal to the keying terminal of the respective tone signal keyer;

a set of chord logic circuits, each connected to one keyswitch of said first group and operative in response to a predetermined D.C. potential of opposite polarity on said first common bus and actuation of said one keyswitch to supply auxiliary keying signals to the keying terminal of a plurality of tone signal keyers of a preselected group of keyers such that said auxiliary keying signals will actuate a group of tone signal keyers associated with notes comprising a musical chord; and mode control means connected to said first common bus for selectively applying a D.C. potential of either said one polarity or said opposite polarity to said first common bus for providing a one-key chording mode or a normal play mode, respectively.

2. Apparatus as claimed in claim 1, wherein the means connecting a keyswitch to a respective tone signal keyer each comprises a first unidirectional conducting device poled in a direction to conduct a potential of said one polarity, and wherein the means connecting a keyswitch to a respective chord logic circuit each comprises a second unidirectional conducting device poled in a direction to conduct a potential of said opposite polarity.

3. Apparatus as claimed in claim 1 or claim 2, wherein said one polarity is positive.

4. Apparatus as claimed in claim 1 or claim 2, wherein said apparatus further comprises:

means connecting a preselected second group of said keyswitches to a common source of D.C. potential of said one polarity for causing the keyswitches of said second group to normally be operative in the normal play mode, and wherein the tone signal keyers associated with the keyswitches of said second group are each connected to receive on its keying terminal an auxiliary keying signal from a chord logic circuit.

5. Apparatus as claimed in claim 4, wherein the means connecting a keyswitch of said second group to a respective tone signal keyer each comprises a unidirectional conducting device poled in a direction to conduct a potential of said one polarity.

6. Apparatus as claimed in claim 4, wherein said apparatus further comprises:

means connecting the balance of said plurality of keyswitches not included in said first and second groups to said common source of D.C. potential and each to a respective tone signal keyer for causing said balance of keyswitches to be operative in only the normal play mode.

7. Apparatus as claimed in claim 6, wherein the means connecting a keyswitch of said balance to a respective tone signal keyer is a direct connection.

8. Apparatus as claimed in claim 1, wherein each of said chord logic circuits comprises:

a bistable latch circuit switchable from a normal first state to a second state in response to a D.C. potential of said opposite polarity and operative to produce when in said second state first and second output signals of different levels, means for deriving from said firsrt output signal an additioinal signal for controlling a pedal note having the same name as the respective keyswitch, and at least one of three auxiliary keying signals corresponding to notes contained in the musical chord having the name of the respective keyswitch, and means for deriving from said second output signal two auxiliary keying signals corresponding to notes that are constant in the musical chord having the name of the respective keyswitch.

9. Apparatus as claimed in claim 8, further including means for re-setting said latch circuit to its normal first state upon release of the respective keyswitch.

10. Apparatus as claimed in claim 9, wherein said apparatus further comprises:

means for inhibiting the re-setting of said latch circuit to its normal first state upon release of a first respective one of the keyswitches of said first group, and enabling the reset of said latch circuit to its normal first state upon depression of a second respective one of said keyswitches so as to cause continuance of the chord information determined by the last-depressed of said keyswitches without requiring the continued depression of any of said keyswitches.

11. Apparatus as claimed in claim 10, wherein said apparatus further comprises:

auxiliary switch means for causing the reset to said latch circuit to its first normal state.

12. Apparatus as claimed in claim 1, wherein said apparatus further comprises:

alpha-numeric indicator means connected to said chord logic circuits and controllable thereby for visually indicating the name of the musical chord being played by the one key chording system.

13. Apparatus as claimed in claim 12, wherein said indicator means comprises:

electronic light-emitting alpha-numeric indicator means, and logic circuit means connecting said chord logic circuits to said alpha-numeric indicator means.

* * * * *

UNITED STATES PATENT AND TRADEMARK OFFICE

CERTIFICATE OF CORRECTION

PATENT NO. : 4,274,320

DATED : June 23, 1981

INVENTOR(S) : Robert A. Finch

It is certified that error appears in the above-identified patent and that said Letters Patent are hereby corrected as shown below:

Title page, line [75], change "Palos Park" to --Mundelein--.

Signed and Sealed this

*Fifteenth* Day of *September 1981*

[SEAL]

*Attest:*

GERALD J. MOSSINGHOFF

*Attesting Officer*

*Commissioner of Patents and Trademarks*